US011800270B2

(12) United States Patent
Bigeh

(10) Patent No.: US 11,800,270 B2
(45) **Date of Patent: *Oct. 24, 2023**

(54) INTEGRATED ACOUSTIC COUPLER FOR PROFESSIONAL SOUND INDUSTRY IN-EAR MONITORS

(71) Applicant: Audix Corporation, Wilsonville, OR (US)

(72) Inventor: Fred Bigeh, Wilsonville, OR (US)

(73) Assignee: Audix Corporation, Wilsonville, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/885,474

(22) Filed: Aug. 10, 2022

(65) Prior Publication Data

US 2022/0386005 A1 Dec. 1, 2022

Related U.S. Application Data

(63) Continuation of application No. 17/166,980, filed on Feb. 3, 2021, now Pat. No. 11,451,893.
(Continued)

(51) Int. Cl.
*H04R 29/00* (2006.01)
*H04R 1/04* (2006.01)
*H04R 1/10* (2006.01)

(52) U.S. Cl.
CPC ..... *H04R 1/04* (2013.01); *H04R 1/1016* (2013.01)

(58) Field of Classification Search
CPC ..... H04R 1/1016; H04R 5/027; H04R 29/00; H04R 29/001; H04R 29/002; H04R 29/003
See application file for complete search history.

(56) References Cited

U.S. PATENT DOCUMENTS 1,603,273 A * 10/1926 Frederick ..... H04R 29/00 381/58
4,038,500 A * 7/1977 Frye ..... H04R 1/083 381/372
(Continued)

FOREIGN PATENT DOCUMENTS

CN 208241890 U * 12/2018
CN 208241890 U 12/2018
(Continued)

OTHER PUBLICATIONS

Butterworth, B., "Fresh From the Bench: G.R.A.S. Sound & Vibration RA040X Ear Simulator," *audioXpress*, (May 15, 2018).
(Continued)

*Primary Examiner* — Ryan Robinson
(74) *Attorney, Agent, or Firm* — Klarquist Sparkman, LLP

(57) ABSTRACT

An integrated acoustic coupler for use in sound engineering testing of an IEM (in-ear monitor). The integrated acoustic coupler comprises an integrated coupler body having an input, a first chamber and an output port. The input defines an IEM seat defined by a foam member and into an which an IEM may be inserted to define an air-tight seal between the foam and the IEM. The first chamber is in fluid communication with the IEM seat and interconnected with at least one second chamber via a passageway configured for creating compliance and impedance to simulate a human ear. The output port is configured for electronically interconnecting to an XLR cable and outputting a signal from an IEM under test to a mixer or audio analyzer.

17 Claims, 7 Drawing Sheets

Related U.S. Application Data

(60) Provisional application No. 62/970,744, filed on Feb. 6, 2020.

(56) References Cited

U.S. PATENT DOCUMENTS

| | | | | |
|---|---|---|---|---|
| 4,586,194 | A * | 4/1986 | Kohashi | H04R 29/001 381/60 |
| 4,788,708 | A * | 11/1988 | Hendrix | H04R 29/001 379/22.02 |
| 6,402,782 | B1 * | 6/2002 | Sibbald | H04R 29/00 623/10 |
| 6,456,717 | B1 * | 9/2002 | Nowka | H04R 29/00 379/1.01 |
| 6,504,937 | B1 * | 1/2003 | Papadopoulos | H03F 3/183 330/10 |
| 9,456,266 | B2 * | 9/2016 | Johansen | H04R 31/00 |
| 9,699,569 | B2 * | 7/2017 | Inagaki | H04R 29/00 |
| 10,264,378 | B2 * | 4/2019 | Ikeda | H04R 29/001 |
| 2008/0181424 | A1 * | 7/2008 | Schulein | H03G 7/002 381/74 |
| 2011/0038487 | A1 * | 2/2011 | Bai | H04R 31/00 381/58 |
| 2011/0164757 | A1 * | 7/2011 | Sibbald | H04R 29/001 381/58 |
| 2012/0219161 | A1 * | 8/2012 | Amada | H04R 3/04 381/74 |
| 2013/0028429 | A1 * | 1/2013 | Amada | H04R 1/1091 381/59 |
| 2013/0039520 | A1 * | 2/2013 | Margolis | H04R 29/001 381/326 |
| 2014/0146973 | A1 * | 5/2014 | Liu | H04R 29/001 381/58 |
| 2015/0264501 | A1 * | 9/2015 | Hu | H04R 29/00 381/58 |
| 2015/0341733 | A1 * | 11/2015 | Ikeda | H04R 5/027 381/59 |
| 2016/0150334 | A1 * | 5/2016 | Lin | H04R 29/001 381/59 |
| 2016/0212539 | A1 * | 7/2016 | Ikeda | G01H 11/08 |
| 2016/0366518 | A1 * | 12/2016 | Strogis | H04S 7/306 |
| 2017/0006380 | A1 * | 1/2017 | Gobeli | H04R 1/1016 |
| 2020/0154221 | A1 * | 5/2020 | Chung | H04R 3/04 |
| 2021/0127221 | A1 * | 4/2021 | Kannan | H04R 25/30 |
| 2021/0136503 | A1 * | 5/2021 | Harvey | A61B 5/117 |
| 2021/0329394 | A1 * | 10/2021 | Hansen | H04R 29/00 |

FOREIGN PATENT DOCUMENTS

| | | | | |
|---|---|---|---|---|
| CN | 109246574 | A * | 1/2019 | H04R 29/001 |
| CN | 109246574 | A | 1/2019 | |
| WO | WO2017/187136 | A1 | 11/2017 | |
| WO | WO-2017187136 | A1 * | 11/2017 | E21B 43/127 |

OTHER PUBLICATIONS

Extended European Search Report for European Application No. 21155472.0, dated May 19, 2021.

International Standard, "Electroacoustics—Simulators of human head and ear—Part 4: Occluded-ear simulator for the measurement of earphones coupled to the ear by means of ear inserts," UEC 60318-4, Edition 1.0, 38 pages (Jan. 2010).

Larson, V. et al., "A Comparison of Three HA-1 Couplers," *Ear and Hearing*, 10(5):330-334 (Oct. 1989).

Wille, M., "High-Frequency Ear Simulator," *GRAS Whitepaper*, 12 pages (Oct. 2017).

Office Action for European Patent Application No. 21155472.0, dated Apr. 17, 2023.

* cited by examiner

INTEGRATED ACOUSTIC COUPLER FOR PROFESSIONAL SOUND INDUSTRY IN-EAR MONITORS

CROSS REFERENCE TO RELATED APPLICATION

This application is a continuation application of U.S. patent application Ser. No. 17/166,980, filed Feb. 3, 2021, which claims the benefit of U.S. Provisional Patent Application No. 62/970,744, filed Feb. 6, 2020, which is hereby incorporated by reference.

FIELD

The present invention relates to apparatus for capturing frequency response of "in-ear monitors" ("IEMs," "earbuds," and "in ear headphones"), and more specifically, to an integrated acoustic coupler for testing and measuring performance characteristics of IEMs.

BACKGROUND

IEMs, which are also known as ear buds or in ear headphones, have gained popularity in recent years and are used for listening to music as well as on music stages and recording studios by musicians. Test and measurement "couplers" are the devices used by manufacturers of IEMs for capturing frequency response during research and development, final production testing, and quality control of IEMs. In the field, professional sound engineers, service centers and in some cases audiophile enthusiasts and hobbyists may use these same couplers to test and verify the performance of their IEMs.

Stated in a very general way, a coupler is a device that interconnects the IEM that is being tested to a microphone so that the signals received by the IEM reliably reproduce the signals that would be received if the IEM was being used by a musician. The goal is for the coupler to comply with the various standards requirements promulgated by the International Electrotechnical Commission (IEC) for "artificial ears." To achieve these goals, the coupler allows the frequency signal that is picked up by the microphone to reproduce response that a user would experience were the IEM in their ear rather than the coupler.

As one typical example, musicians may use an IEM during live performances both as an alternative to a stage monitor system, or in combination with such a system. The musician may ask the sound engineer to check or adjust their IEM during sound check for an upcoming concert. Most IEMs are custom made, so that the physical shape of the ear-worn parts conform closely to the physical shape of the user's ear. As a result, a second person cannot wear a first person's IEM, so sound engineers have to rely on some sort of audio test to determine the response of the device and adjust the audio response (equalization) so that the IEM matches what the musician is asking for. When using existing couplers outside of a controlled environment or sound lab, the audio testing of IEMs can be very cumbersome.

FIG. 1 of the drawings illustrates a typical existing coupler for testing IEMs. The coupler consists of multiple components that are assembled together: a conditioning amplifier or power supply, an output to the mixer (mix board) or audio analyzer, an AC power supply (or battery) for the conditioning amplifier, and an ear bud coupler module (ear bud coupler or coupler module) that is connected with a preamplifier and cable to the conditioning amplifier. The ear bud coupler module receives an end of the ear bud. The combination of components can be cumbersome, difficult to assemble and use, and fragile (at least outside of a controlled environment such as a sound lab, factory, etc.). While present systems are very accurate, they are not practical for use in studio, concert or live performance settings where the engineers must obtain accurate, repeatable measurements quickly from a coupler that interfaces to their testing devices through standard connections, at least because the sound industry connection standards that are used worldwide are different from the test and measurement connection standards.

In short, current couplers do not lend themselves to use in a studio, let alone a live performance setting. Further complicating the task for sound engineers is the expediency/time constraint to which the engineers must adhere to determine the condition of the IEM and make necessary frequency response adjustments that the musician/artist is requesting. To measure and adjust ear bud response, the IEM must be sealed very well to the coupler to provide accurate and repeatable measurements. Sound engineers who use the existing coupler shown in FIG. 1 often use putty formed around the ear bud and the coupler in an attempt to achieve adequate sealing between these two components. As noted, most professional IEMs use custom-fitted ear buds—each ear bud is molded specifically for the user's ear. As such, the putty needs to be redone for each ear bud, each use, and each test. Not only is putty inconvenient to use, but with this system it is often difficult to get repeatable results and requires reapplying putty to the coupler and/or ear bud for each test that is being completed.

There is a need for an acoustic testing apparatus for IEMs that reduces the drawbacks with existing systems.

SUMMARY

Described below are implementations of an integrated acoustic coupler that addresses the shortcomings of current couplers.

According to a first implementation, an integrated acoustic coupler for use in sound engineering testing of an IEM (in-ear monitor) comprises an integrated coupler body having an input defining an IEM seat defined by a deformable member and into an which an IEM may be inserted to define an air-tight seal between the deformable member and the IEM. The integrated coupler body also comprises a first chamber in fluid communication with the IEM seat and interconnected with at least one second chamber via at least one passage configured for creating compliance and impedance to simulate a human ear and an output port configured for electronically interconnecting to an XLR cable and outputting a signal from an IEM under test to a mixer or audio analyzer.

The integrated acoustic coupler include a transducer positioned in operative relationship with the first chamber and an electrical circuit connecting the transducer and the output port. The circuit can comprise an integrated circuit element positioned in an interior of the integrated coupler body.

The IEM seat can be positioned in an adaptor that is removably attached to the integrated coupler body. The output port can comprise a male XLR plug interface.

The first chamber, the passageway and at least a portion of the second chamber can be defined in a separate sleeve fitted in the integrated coupler body.

The integrated coupler body can include a generally cylindrical base in which the output port is positioned, a projecting cylindrical boss and adapter wherein the IEM seat is positioned, wherein the adapter is removably coupled to the threaded boss.

The adapter can be a first adapter, and the integrated acoustic coupler can comprise at least one second adaptor different from the first adaptor, and wherein the first and second adaptors are sized and shaped for testing an IEM of a first type and an IEM of a second type, respectively.

The deformable member can comprise a polymer foam.

The first chamber can be axially aligned with the IEM seat and the second chamber can have an annular shape and be positioned to at least partially surround the first chamber. The at least one passage can extend laterally to interconnect the first chamber and the second chamber.

In some implementations, the integrated acoustic coupler can comprise at least a third chamber in fluid connection with the first chamber and the second chamber. In some implementations, the integrated acoustic coupler can comprise at least a fourth chamber in fluid connection with the first chamber, the second chamber and the third chamber.

In a method implementation, a method of testing an IEM (in-ear monitor) for a studio, concert or other live performance, comprises providing an integrated acoustic coupler with an input defining a deformable IEM seat into which an IEM may be inserted to define an air-tight seal between the seat and the IEM, providing an output port from the integrated acoustic coupler and configured for electronically interconnecting by an XLR cable to a preamp or mixer, pressing an IEM into the IEM seat to define an air-tight seal between the seat and the IEM, connecting an audio test signal to the IEM inserted into the IEM seat; connecting an XLR cable to the output port, and performing a sound check on the IEM.

The method can comprise removably coupling an adaptor to an integrated coupler body, and wherein an IEM seat is defined in the adaptor.

The adapter can be a first adapter, and there can be at least one second adaptor different from the first adaptor, and wherein the first and second adaptors are sized and shaped for testing an IEM of a first type and an IEM of a second type, respectively.

The method can include connecting the integrated acoustic coupler to an acoustic calibrator for calibration.

Thus, in some implementations, the integrated coupler (a) integrates the numerous components of the existing devices into a small puck that is compact, ergonomic and does not require a dedicated stand, eliminates the need for an external coupler pre-amp and conditioning power supply (as well as a battery or external AC power supply), and connects to audio sound mixers or audio analyzers with the sound industry standard single XLR cable and operates on the existing standard 48 volt supply, which is standard on all professional sound mixers, preamps and some audio analyzers; and (b) uses an expandable polymer foam receptacle for receiving the IEM to create an IEM seat that defines a highly repeatable seal between the IEM and the coupler to provide repeatable, accurate verification of acoustic performance.

The foregoing and other objects, features, and advantages will become more apparent from the following detailed description, which proceeds with reference to the accompanying figures.

BRIEF DESCRIPTION OF THE DRAWINGS

The invention will be better understood and its numerous objects and advantages will be apparent by reference to the following detailed description of the invention when taken in conjunction with the following drawings.

DETAILED DESCRIPTION

Implementations of the integrated coupler will now be described in detail with reference to the drawings. Directional terms used herein correspond to the convention wherein, for instance: "upper" refers to the direction above and away from a ground plane; "lower" is generally in the opposite direction, "inward" is the direction from the exterior toward the interior of the component, "vertical" is the direction normal to a horizontal ground plane, and so on.

Figure 1:
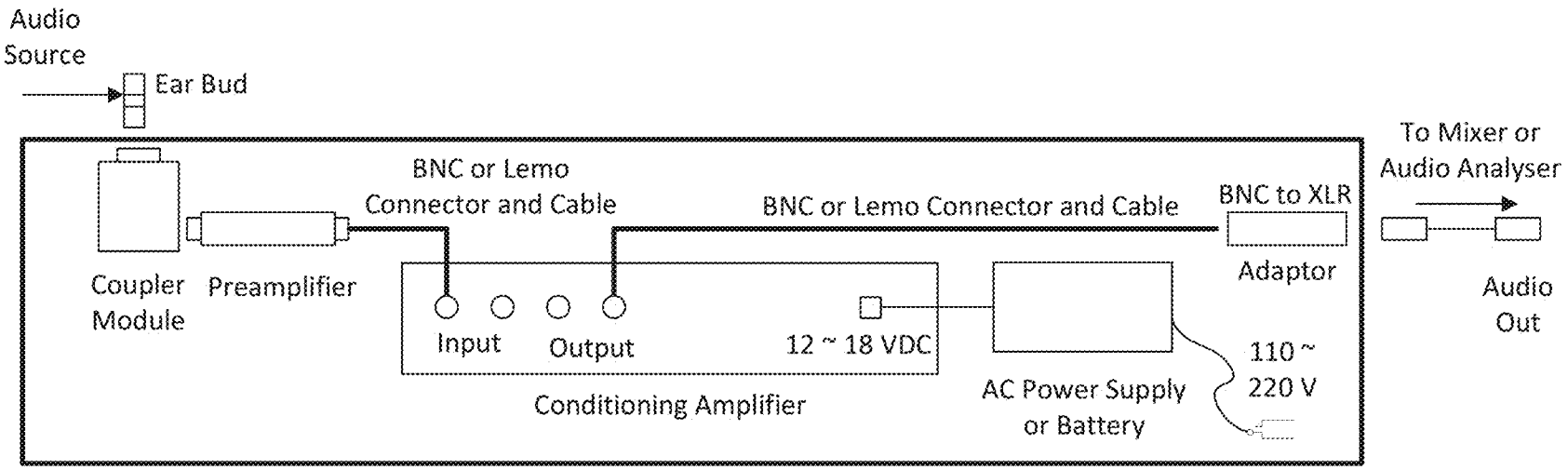
Prior Art Fig. 1
FIG. 1 is a schematic diagram of a typical, prior art acoustic coupler or coupling assembly (or system) for testing acoustic performance of an IEM.

The prior art multi-component coupler shown in FIG. 1 is described above. To reiterate the shortcomings of these laboratory grade devices in professional sound applications, there are two primary problems: (a) the multi-component coupler systems having a combination or assembly of discrete components were primarily designed for use in and interface with equipment typically found in R&D, lab or production settings, and do not meet the requirements of professional audio industry standard connections, ease and rapidity of use in the time-constrained sound engineer work environments (in studios, theatrical and live performance settings, etc.), and (b) the use of putty formed around the ear bud and the coupler in an attempt to provide adequate sealing between the ear bud and the ear-bud seat is inconvenient, and does not form a reliable, repeatable seal, which leads to difficulties in obtaining reliable and repeatable results. The schematic illustration of FIG. 1 shows the complicated connections required for existing multi-component couplers and why the devices are difficult to use in any setting other than a laboratory.

Figure 2:
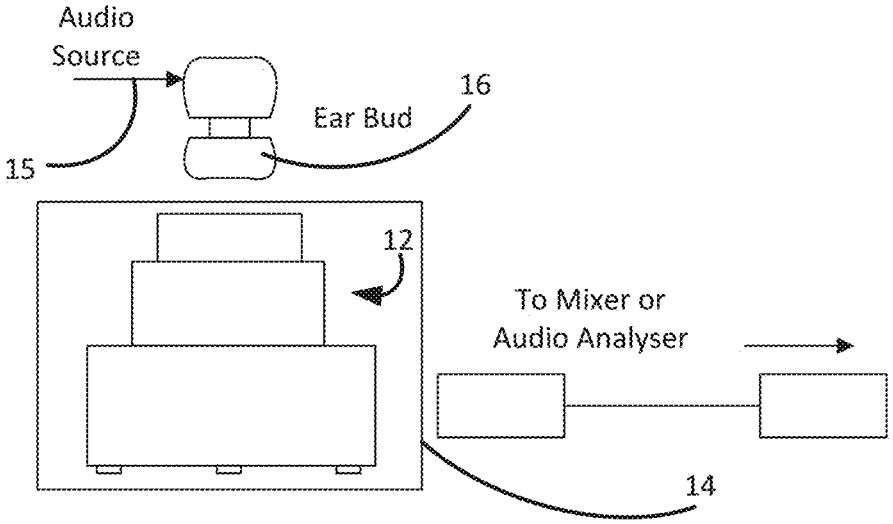
FIG. 2 is a schematic diagram of a new integrated acoustic coupler for testing acoustic performance of an IEM.

The integrated acoustic coupler 10 according to a first implementation is shown schematically in FIG. 2. The integrated acoustic coupler 10 can have a configuration (body) that resembles a cylinder or stacked cylinders in external appearance (see, e.g., FIGS. 3, 4 and 6), and thus the assembly is sometimes referred to as a "puck" 12. In FIG. 2, the integrated puck 12 is shown relative to its output, e.g., an output 14 that is for a single XLR cable that connects to a typical audio mix board or audio analyzer (neither of which are shown but which are standard equipment in the audio industry). As also shown in FIG. 2, an in-ear-monitor ("IEM" or "ear bud") 16 is positioned for being attached and sealed to a seat 18 on the puck 12, as described in detail below. The schematic illustration of the new integrated acoustic coupler of FIG. 2, when compared to the prior art system of FIG. 1, shows the vast improvements that have been made and illustrate why the present invention is usable in a non-laboratory setting (such as during live performances, etc.).

Figure 3:
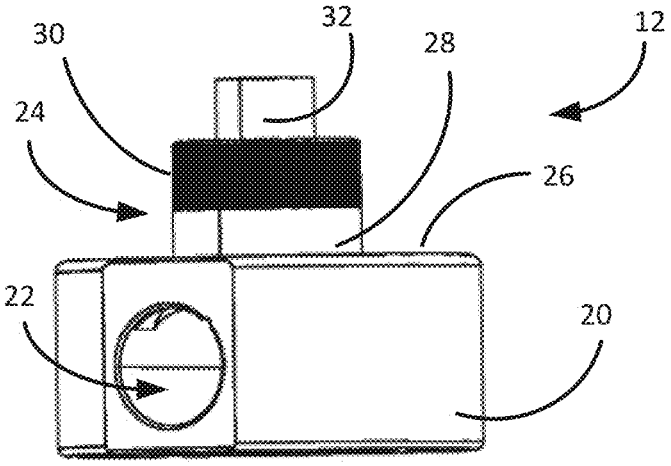
FIG. 3 is a side elevation view of a representative implementation of the new integrated acoustic coupler, illustrating the XLR connector port for receiving an XLR connector, which is one suitable type of standardized connector for connecting to the mixer or audio analyzer.
Figure 4:
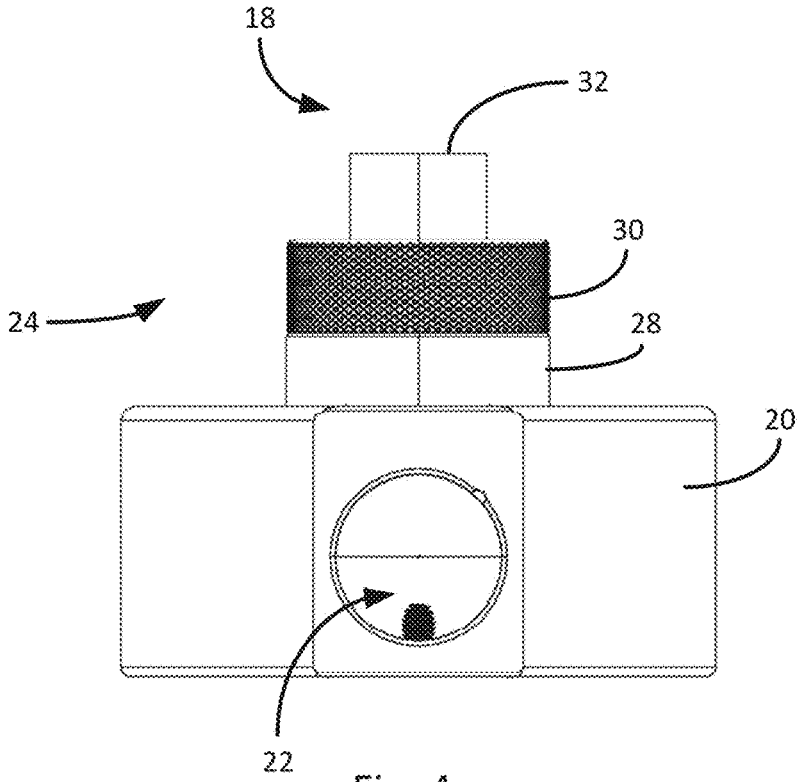
FIG. 4 is side elevation view of the integrated acoustic coupler of FIG. 3 shown from a different orientation.
Figure 5:
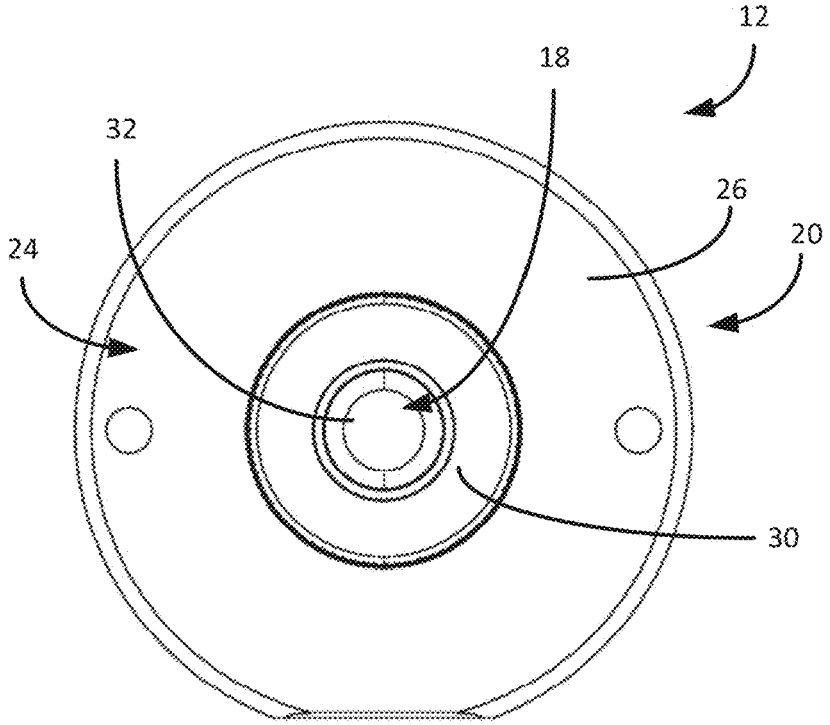
FIG. 5 is a top plan view of the integrated acoustic coupler of FIG. 4.

The puck 12 operates on the standard 48-volt microphone supply, which is standard on all professional sound mixers, preamps and some audio analyzers. Turning to FIGS. 3 through 5, the puck 12 is shown in several views. The puck 12 comprises a generally cylindrical base 20 that has an output port 22 for connection of the XLR cable, such as is shown in FIG. 2, or a similar specialized standard connection. In some implementations, the output port 22 has a male XLR plug connector. A cylindrical boss 24 extends upwardly from an upper surface 26 of the base 20 and defines portions of the seat 18 for receiving the IEM 16. The boss 24 has a lower portion 28 and an adaptor 30 that is threaded onto the lower portion 28 (e.g., like a cap). The threads on the adaptor 30 are preferably compatible with industry-standard couplers. The axial center portion of the adaptor 30 defines the seat 18 for receiving the IEM and includes an expandable and moldable polymer foam 32, which as noted below, defines a coupler interface into which the IEM 16 is received. The polymer foam can also be described as being deformable and/or resilient.

Figure 6:
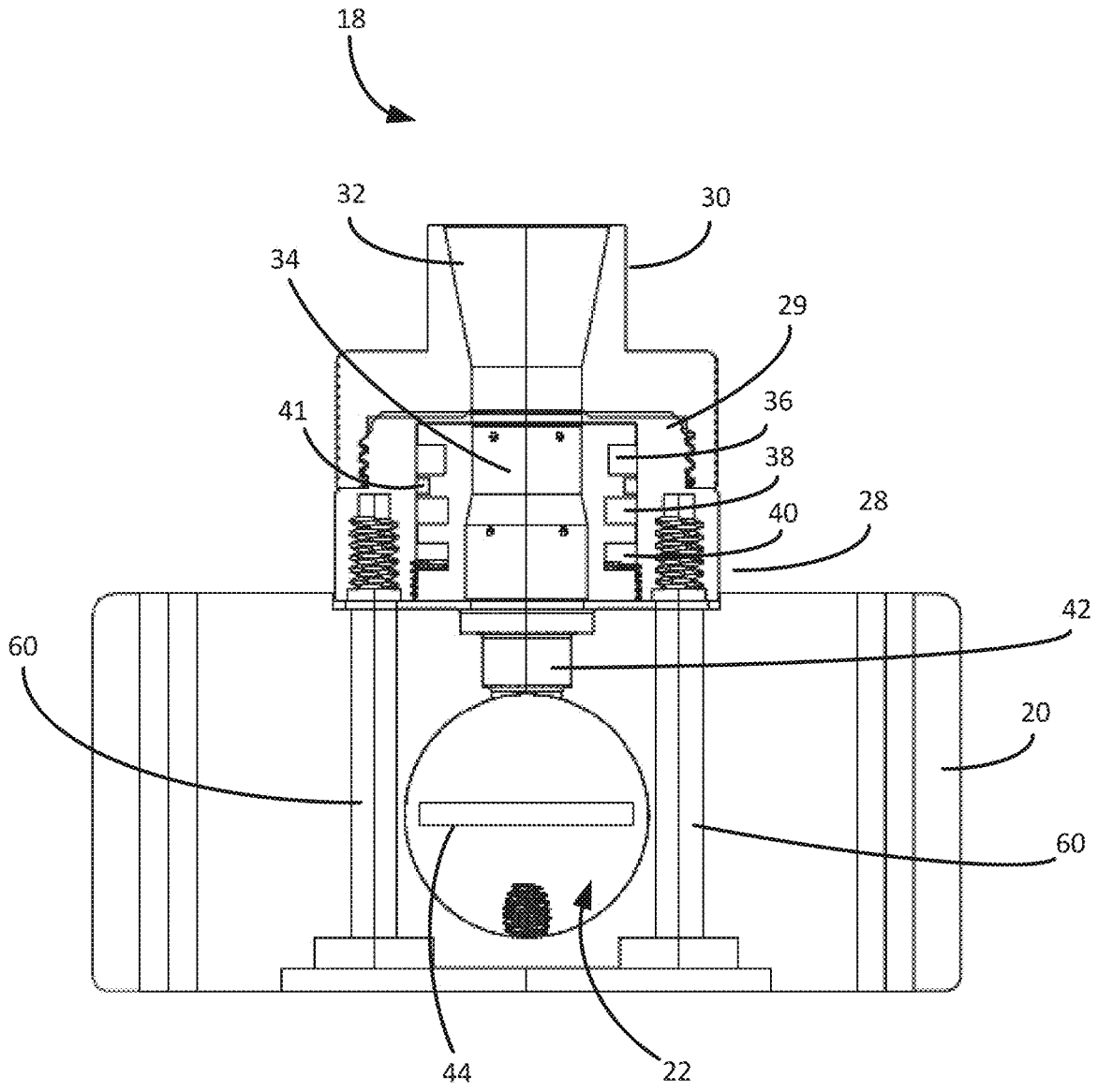
FIG. 6 is a cross sectional view of the integrated acoustic coupler shown in FIG. 4, illustrating various structures and components thereof.

With reference to the cross-sectional view of FIG. 6, it may be seen that from the ear bud seat 18, there is a passageway leading at least partially through the puck 12 in which one or more chambers are defined. The number of chambers and their volumes as illustrated in FIG. 6 are exemplary and illustrative only. For example, a chamber A (shown at 34 in FIG. 6) can have a volume of approximately 559 $mm^3$. The chamber A is a main or central chamber, and a central axis of the passageway extends through the chamber A (i.e., vertically in FIG. 6).

Additional chambers B, C, D are annular in shape and separated from chamber A by a lateral wall, but the chambers B, C, and D are each interconnected with chamber A by small passages extending generally laterally. The chamber B (shown at 36) can have a volume of approximately 140 $mm^3$. The chamber C (shown at 38) can have a volume of approximately 147 $mm^3$. The chamber D (shown at 40) can have a volume of approximately 141 $mm^3$.

Figure 7A:
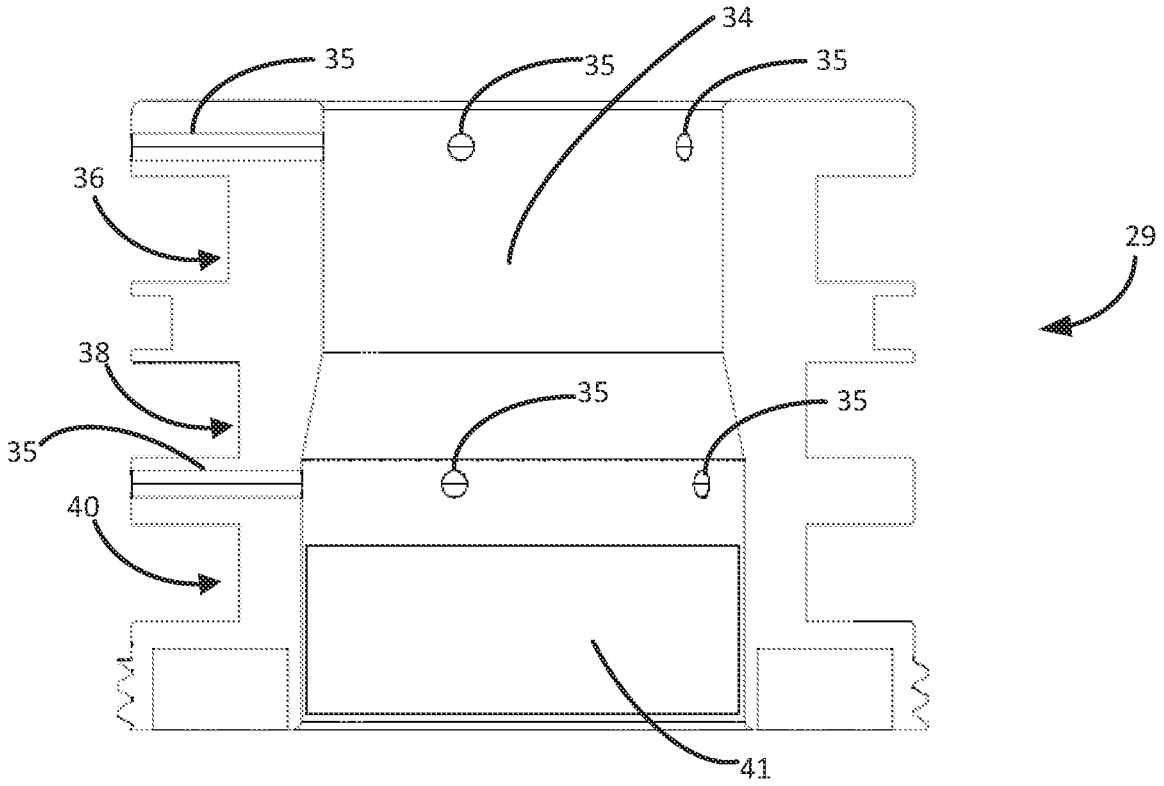
FIG. 7A is a sectioned view of a sleeve shown in FIG. 6.

FIG. 7A is an enlarged section view in elevation showing an interior of the seat 18 to illustrate the chamber A 34, chamber B 36, chamber C 38 and chamber D 40 and passages 35 extending through a lateral wall(s) to connect the chambers on either side. The connections between the chamber A and the chambers B, C and D via the passages 35, create the compliance and impedance simulating the human ear. The passages 35 may have any suitable size and shape. For example, in the illustrated implementation, the passages have a generally circular cross-section and volumes of approximately 0.618 $mm^3$ to 0.697 $mm^3$. Any suitable number of passages may be provided. For example, in the illustrated implementation, there are five upper passages and five lower passages, and the upper and lower passages extend radially at approximately equal angles about the central axis. Thus, only three of the upper passages 35 and three of the lower passages 35 are visible in section view of FIG. 7A at the selected orientation.

The chamber A, at least portions of chambers B, C and D, and the interconnecting passages 35, may be defined in one or more separate components. For example, in the illustrated implementation of FIG. 7A, the chambers 34 and inner portions of the chambers 36, 38 and 40 and the internal passages 35 are defined in a sleeve 29 that is shaped to fit within a bore of the lower portion 28. The sleeve 29 may be formed of a brass alloy or stainless steel, or any other suitable material. The sleeve may include an acoustic damper 41 as shown in FIG. 7A, which is fit to the inner dimension of the space of the passageway near its lower end. The acoustic damper dampens the acoustic signal from the IEM received in the seat (or other source). The acoustic damper can be made of a foam or other suitable material. As shown in FIG. 6, there may be an O-ring 41 positioned between the sleeve 29 and the inner surface of the bore.

Figure 7B:
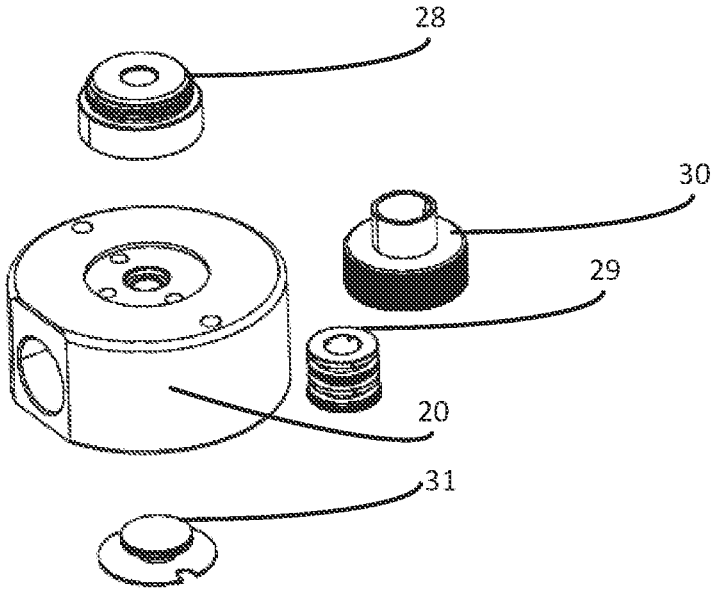
FIG. 7B is an exploded perspective view of showing some of the components of the integrated acoustic coupler.

The lower portion 28 can be coupled to the base 20 by bolts, such as the bolts 60 as seen in FIG. 6. As best shown in FIG. 7B, the base 20 can have a bottom cap 31 for providing access to an interior of the puck 12.

The puck 12 includes a transducer 42 that extends from chamber A to its connection to an integrated circuit board 44 within the base 20, which can be seen in FIG. 6 through the output port 24. The circuit board 44 includes electronic components arranged in one or more circuits to carry out the functions of the integrated acoustic coupler 10. The transducer 42 converts the audio signal to an electrical signal. The circuit increases the electrical signal level before the electrical signal is output from the puck 12.

In use, the IEM 16 is pushed into the coupler interface that is defined by the polymer foam 32 in seat 18 (i.e., the insertion point) so that a good seal, ideally an air-tight seal, is formed between the IEM 16 and the foam 32. A good seal between the IEM 16 and the puck 12 is vital for accurate and repeatable measurements. The polymer foam 32 enables a highly repeatable seal. Materials other than polymer foam can also be used. The XLR cable (FIG. 2) is connected to the output port 22, and the IEM 16 is connected to a cable 15 (FIG. 2) that extends to an audio source (e.g., an industry-standard preamp or mixer) that the sound engineer is using.

With continuing reference to FIG. 6, internally in the puck 12, with the IEM 16 seated in polymer foam 32, there is established a direct connection to the opening of chamber A 34. Chamber A is connected to chamber B 36, chamber C 38 and chamber D 40 with ten passages as described above, which in one implementation have a total volume of 6.1 $mm^3$ to create the compliance and impedance that simulates the human ear. The transducer 42 is located at the base of chamber A and is electrically connected to the integrated circuit 44. Audio signals from the IEM are picked up by the combination of the transducer 42 and integrated circuit 44 (circuit board), and fed via the XLR output port 22 and audio-industry XLR cable connection to a mixer or analyzer.

With these connections made, the sound engineer can perform a sound check on the IEM 16 and adjust its response accordingly. More specifically, the sound engineer performs a sound check on the IEM and adjusts its response accordingly without any additional equipment in the testing chain. In other words, the sound engineer inserts the integrated acoustic coupler 10 into the IEM sound setup that is already in place without needing to make any changes to the setup, and then confirms and adjusts the EQ sound shaping to the IEM user's requirements (e.g., the IEM user can be a musician or other performer). Once the IEM is adjusted as required, the IEM may be removed from the "chain" of equipment, and the engineer has access to the data for the next venue, or for verification and future EQ setups.

Figure 8:
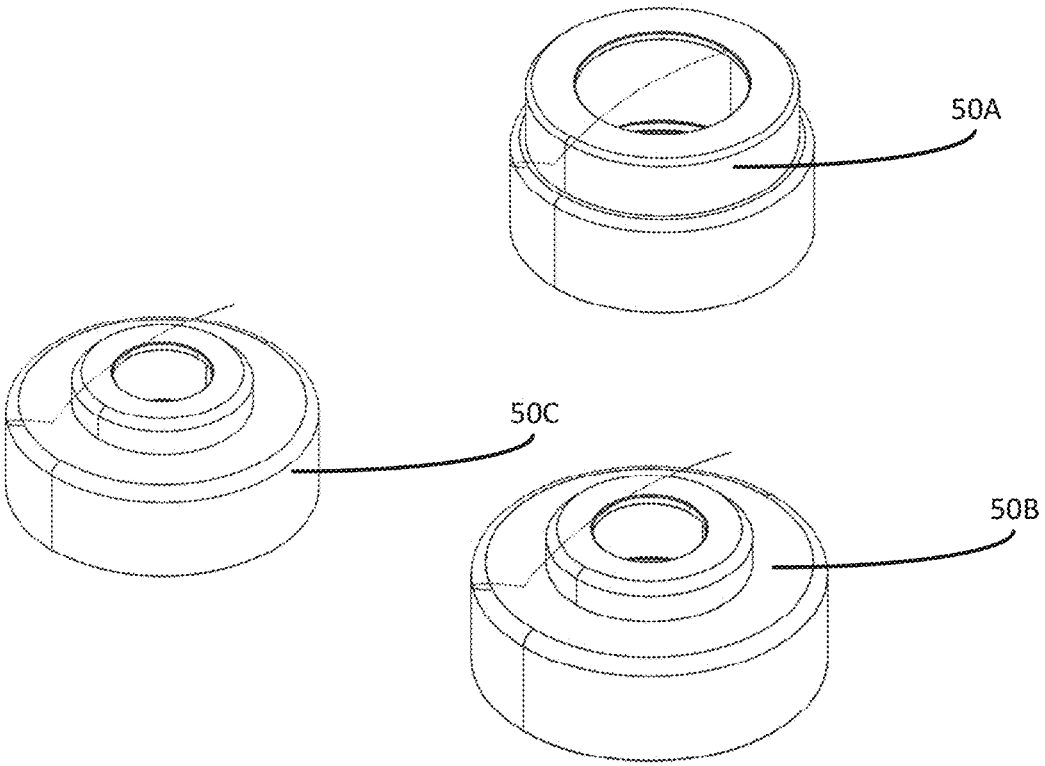
FIG. 8 is a perspective view showing three representative adaptors that can be used with the integrated acoustic coupler.

In addition to the adaptor 30, the puck 12 can be used with other adaptors. FIG. 8 is a perspective view showing three different adaptors 50A, 50B and 50C that are representative of the different adaptors that can be used with the puck 12 to allow different IEMs and other similar devices to be appropriately positioned and sealed for proper testing and adjustment. Each of the adaptors 50A, 50B and 50C can have different external geometry, such as to meet different seating requirements, as well as different internal geometry, but preferably has the same internal thread to allow for easy installation on the lower portion 28 when needed.

Figure 9:
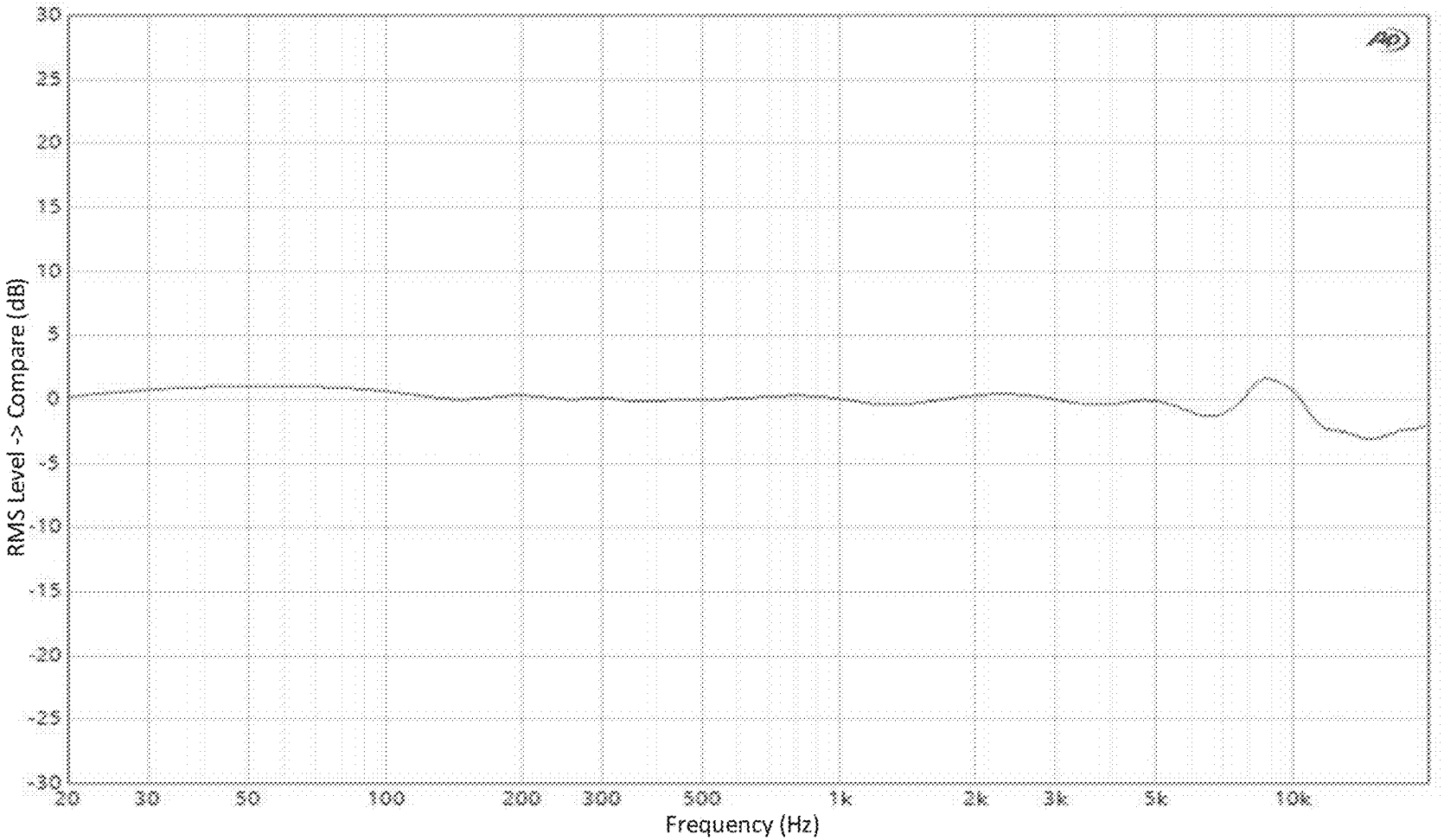
FIG. 9 is a graph of the response of a representative integrated acoustic coupler relative to a lab standard reference coupler.

In comparison testing, the integrated acoustic coupler/puck 12 has performed very close to a conventional, laboratory grade ear coupler, e.g., such as is shown in the graph of FIG. 9. FIG. 9 is a graph from 0 to 10 k Hz of the response of a representative integrated acoustic coupler relative to a G.R.A.S. RA 0401 Hi Resolution Ear Simulator (coupler), which can be used as a lab standard reference coupler for measurement of IEMs, headphones and couplers.

One of the adaptors may be configured for connecting the integrated acoustic coupler to an acoustic calibrator to achieve greater measurement precision. A Sound Level Calibrator or acoustic calibrator is used to produce a known sound pressure level (typically 94 dB SPL at 250 Hz or 1000 Hz). The calibrator is fitted over a microphone or, in this case, a coupler, and the reading is either checked manually by the user or automatically by a meter. The integrated acoustic coupler can be supplied with calibration data such as of the type that is most useful for comparative analysis when transfer function data is sent or received from a source that uses an IEC 60318-4 compliant device. Use of calibration data is not required in all testing of IEMs, however, because it can be applied post-measurement, if required.

In one example, test data for a specific integrated acoustic coupler included the following: Test Frequency 1000 Hz; Measured Level 7.3 mV at 94 dB SPL; Temperature 23° C., Relative Humidity 39%, Barometric pressure 102.4 kPa. It is noted that measured levels can be impacted by phantom power voltage and other factors in the audio path. If an IEM SPL level is being measured in addition to frequency response, then making an amplitude calibration with an IEC 60942 compliant sound calibrator through the IEM sound path is recommended.

In view of the many possible embodiments to which the disclosed principles may be applied, it should be recognized that the illustrated embodiments are only preferred examples and should not be taken as limiting the scope of protection. Rather, the scope of protection is defined by the following claims. We therefore claim all that comes within the scope and spirit of these claims.

I claim:

1. An integrated acoustic coupler for use in sound engineering testing of an IEM (in-ear monitor), comprising:

an integrated coupler body having an input defining an IEM seat having a deformable member and into an which an IEM may be inserted to define a seal between the deformable member and the IEM;

a first chamber in fluid communication with the IEM seat and interconnected with at least one second chamber via at least one passage configured for creating compliance and impedance to simulate a human ear;

a transducer positioned in operative relationship with the first chamber;

an integrated circuit element connected to the transducer; and an output port connected to the integrated circuit and configured for electronically interconnecting to an XLR cable and outputting a signal from an IEM under test to an XLR input of a mixer.

2. The integrated acoustic coupler of claim 1, wherein the IEM seat is positioned in an adaptor that is removably attached to the integrated coupler body.

3. The integrated acoustic coupler of claim 1, wherein the output port comprises a male XLR plug interface.

4. The integrated acoustic coupler of claim 1, wherein the first chamber, the passage and at least a portion of the second chamber are defined in a separate sleeve fitted in the integrated coupler body.

5. The integrated acoustic coupler of claim 1, wherein the integrated coupler body includes a generally cylindrical base in which the output port is positioned, a projecting cylindrical boss and adapter wherein the IEM seat is positioned, wherein the adapter is removably coupled to the boss.

6. The integrated acoustic coupler of claim 5, wherein the adapter is a first adapter, further comprising at least one second adaptor different from the first adaptor, and wherein the first and second adaptors are sized and shaped for testing an IEM of a first type and an IEM of a second type, respectively.

7. The integrated acoustic coupler of claim 1, wherein the deformable member comprises a polymer foam.

8. The integrated acoustic coupler of claim 1, wherein the first chamber is axially aligned with the IEM seat and the second chamber has an annular shape and is positioned to at least partially surround the first chamber, and wherein the at least one passage extends laterally to interconnect the first chamber and the second chamber.

9. The integrated acoustic coupler of claim 1, further comprising at least a third chamber in fluid connection with the first chamber and the second chamber.

10. The integrated acoustic coupler of claim 9, further comprising at least a fourth chamber in fluid connection with the first chamber, the second chamber and the third chamber.

11. A method of testing an IEM (in-ear monitor) for a studio, concert or other live performance, comprising:

providing an integrated acoustic coupler with an input having a deformable IEM seat into which an IEM may be inserted to define a seal between the seat and the IEM;

providing an output port from the integrated acoustic coupler and configured for electronically interconnecting by an XLR cable to an XLR input of a mixer, the integrated acoustic coupler having a transducer and an integrated circuit interconnecting the transducer and the output port;

pressing an IEM into the IEM seat to define a seal between the seat and the IEM;

connecting an audio test signal to the IEM inserted into the IEM seat;

connecting the XLR cable to the output port and to an XLR input of the mixer; and performing a sound check on the IEM.

12. The method of claim 11, wherein the integrated acoustic coupler comprises a first chamber in fluid communication with an IEM seat and at least a second chamber connected to the first chamber by a passage.

13. The method of claim 12, further comprising at least a third chamber in fluid connection with the first chamber and the second chamber.

14. The method of claim 13, further comprising at least a fourth chamber in fluid connection with the first chamber, the second chamber and the third chamber.

15. The method of claim 11, further comprising removably coupling an adaptor to an integrated coupler body, and wherein an IEM seat is defined in the adaptor.

16. The method of claim 15, wherein the adapter is a first adapter, further comprising at least one second adaptor different from the first adaptor, and wherein the first and second adaptors are sized and shaped for testing an IEM of a first type and an IEM of a second type, respectively.

17. The method of claim 11, further comprising connecting the integrated acoustic coupler to an acoustic calibrator for calibration.

* * * * *